US005834172A

United States Patent [19]

Zengerle et al.

[11] Patent Number: 5,834,172

[45] Date of Patent: Nov. 10, 1998

[54] PHOTOGRAPHIC COATING COMPOSITIONS AND PHOTOGRAPHIC ELEMENTS MADE THEREFROM

[75] Inventors: Paul Leo Zengerle, Rochester; John Victor Nelson, Fairport; Mary Christine Brick, Webster, all of N.Y.

[73] Assignee: Eastman Kodak Company, Rochester, N.Y.

[21] Appl. No.: 606,145

[22] Filed: Feb. 23, 1996

[51] Int. Cl.[6] ..... G03C 1/06; G03C 1/815; G03C 1/825

[52] U.S. Cl. ..... 430/517; 430/510; 430/511; 430/522; 430/505; 430/264; 430/598; 430/546; 430/631; 430/640; 430/551

[58] Field of Search ..... 430/505, 510, 430/511, 517, 522, 264, 598, 546, 631, 640, 551

[56] References Cited

U.S. PATENT DOCUMENTS

| | | | |
|---|---|---|---|
| 2,538,008 | 1/1951 | Keyes et al. | 260/465 |
| 2,538,009 | 1/1951 | Keyes et al. | 95/8 |
| 4,366,236 | 12/1982 | Takahashi | 430/505 |
| 4,420,555 | 12/1983 | Krueger et al. | 430/507 |
| 4,447,523 | 5/1984 | Ross et al. | 430/505 |
| 4,855,221 | 8/1989 | Factor et al. | 430/510 |
| 4,857,446 | 8/1989 | Diehl et al. | 430/510 |
| 4,861,700 | 8/1989 | Shuttleworth et al. | 430/517 |
| 4,900,653 | 2/1990 | Factor et al. | 430/522 |
| 4,923,787 | 5/1990 | Harder | 430/489 |
| 4,923,788 | 5/1990 | Shuttleworth et al. | 430/507 |
| 4,927,744 | 5/1990 | Henzel et al. | 430/566 |
| 4,940,654 | 7/1990 | Diehl et al. | 430/522 |
| 4,948,717 | 8/1990 | Diehl et al. | 430/510 |
| 4,948,718 | 8/1990 | Factor et al. | 430/522 |
| 4,950,586 | 8/1990 | Diehl et al. | 430/507 |
| 4,971,890 | 11/1990 | Okada et al. | 430/264 |
| 5,213,956 | 5/1993 | Diehl et al. | 430/522 |
| 5,213,957 | 5/1993 | Adachi | 430/522 |
| 5,230,992 | 7/1993 | Miyahashi et al. | 430/505 |
| 5,300,394 | 4/1994 | Miller et al. | 430/137 |
| 5,360,702 | 11/1994 | Zengerle et al. | 430/505 |
| 5,457,014 | 10/1995 | Zengerle et al. | 430/522 |
| 5,459,026 | 10/1995 | Nakamura et al. | 430/522 |
| 5,460,933 | 10/1995 | Brick et al. | 430/505 |
| 5,468,598 | 11/1995 | Miller et al. | 430/372 |
| 5,543,277 | 8/1996 | Singer et al. | 430/505 |
| 5,629,140 | 5/1997 | Harder et al. | 430/409 |

FOREIGN PATENT DOCUMENTS

| | | |
|---|---|---|
| 0 430 186 | 11/1995 | European Pat. Off. . |
| 695873 | 8/1953 | United Kingdom . |
| 760739 | 11/1956 | United Kingdom . |

*Primary Examiner*—Geraldine Letscher
*Attorney, Agent, or Firm*—Edith A. Rice

[57] ABSTRACT

A photographic coating composition comprising an aqueous medium containing a hydrophilic colloid and having dispersed therein solid particles of a yellow filter dye also contains a oxidized developer scavenger of formula III (III)

wherein $x^1$=hydrogen or a process cleavable group;

$R^{14}$=an electron withdrawing and aqueous solubilizing group;

$R^{15}$=a substituent group;

$R^{16}$=a ballasting group;

$R^{17}$=a substituent group;

i=1, 2, 3, or 4; and j=1, 2, 3, or 4.

The coating composition is stable with regard to crystal growth of the dispersed solid particles of filter dye even when held at coating temperatures (about 45° C.) for several hours.

13 Claims, 2 Drawing Sheets

PHOTOGRAPHIC COATING COMPOSITIONS AND PHOTOGRAPHIC ELEMENTS MADE THEREFROM

FIELD OF THE INVENTION

This invention relates to a photographic coating composition comprising a yellow filter dye in combination with a hydrazide oxidized developer scavenger and to a photographic element made therefrom.

BACKGROUND OF THE INVENTION

Photographic materials often contain layers sensitized to different regions of the spectrum, such as red, blue, green, ultraviolet, infra-red, X-ray, to name a few. A typical color photographic element contains a layer sensitized to each of the three primary regions of the visible spectrum, i.e., blue, green and red. All silver halide emulsions used in these photographic elements have an intrinsic sensitivity to exposure by blue light (light of a wavelength between 400 and 500 nm). Increased sensitivity to blue light, along with sensitivity to green light or red light, is imparted through the use of various sensitizing dyes adsorbed to the silver halide grains. Exposure of green or red-sensitive emulsions by blue light results in a significant degradation of the photographic element's ability to accurately reproduce the colors of the original scene. As a result, the control of blue light exposure within a silver halide photographic element is a critical issue to the performance of these elements. Therefore, a material that absorbs blue light is usually coated between the blue sensitive layers and the remaining light sensitive layers of the element to prevent blue light from exposing the non-blue sensitive layers.

One commonly used blue light absorbing material is colloidal, or Carey-Lea, silver (J. Kapecki and J. Rodgers, "Color Photography" in *Kirk-Othmer Encyclopedia of Chemical Technology—Fourth Edition*, Volume 6, pp 965–1002, John Wiley and Sons, Inc., 1993). However, colloidal silver absorbs some green light and tends to increase the fog of silver halide emulsions in adjacent layers. The green light absorption results in a speed loss that is corrected through the use of larger grain size emulsions; however, this decreases image quality due to higher granularity. The increased fog requires coating higher silver halide emulsion laydowns or other corrective measures that have various costs associated with them.

An alternative blue light absorbing material is a yellow filter dye such as those disclosed in U.S. Pat. Nos. 2,538,008, 2,538,009 and 4,420,555, and U.K. Pat. Nos. 695,873 and 760,739. These dyes are often incorporated as microcrystalline dye dispersions. U.S. Pat. Nos. 4,950,586, 4,948,718, 4,948,717, 4,940,654, 4,923,788, 4,900,653, 4,861,700, 4,857,446, 4,855,221, 5,213,956 and 5,213,957 and EP 430,186 disclose the use of various dyes in solid particle dispersions. When properly designed, these dyes do not result in the green speed losses and increased fog caused by colloidal silver.

Photographic elements generally form images through a reaction in which a developer reduces exposed silver halide to metallic silver. The oxidized developer then often reacts with a coupler that forms or releases an image-forming dye or other photographically useful compound. However, unwanted reactions between oxidized developer and components of the photographic element can cause adverse effects such as color contamination. For example, in a multilayer color photographic element, a different color image dye is formed in each color-sensitive layer of the element by the reaction of oxidized developer generated in that layer with a dye forming coupler incorporated in the same layer. Migration of oxidized developer generated in one color-sensitive layer to another layer where it can react with a dye forming coupler incorporated in the other layer can cause unwanted dye formation, adversely effecting color image reproduction.

In order to minimize unwanted reactions between oxidized developer and components of the photographic element, oxidized developer scavengers are used. These scavengers are incorporated in locations, such as interlayers or anti-halation layers, to prevent or reduce the undesired reaction of oxidized developer with components in the element. Oxidized developer scavengers are well-known in the art and are described, for example, in U.S. Pat. Nos. 4,366,236 to Takahashi, 4,447,523 to Ross et al., and 4,927,744 to Henzel et al. Hydrazide oxidized developer scavengers are disclosed in U.S. Pat. No. 4,923,787 to Harder and in U.S. Pat. Nos. 4,971,890 to Okada et al. and 5,230,992 to Miyahashi et al.

It may be desirable for the oxidized developer scavenger and the yellow filter dye to be contained in the same layer. In this case, they are generally applied to a photographic support in the same coating composition and must be compatible with one another in the composition prior to being coated. That is to say that they should remain stable in the presence of each other, for example, when held in a coating composition at elevated temperatures for extended periods of time.

PROBLEM TO BE SOLVED BY THE INVENTION

A practical problem which has occurred when oxidized developer scavenger dispersions and filter dye dispersions are held together in a coating composition prior to coating is that the filter dye particles grow into relatively large crystals ranging from 4 to 20 micrometers in length. These crystals result in filter plugging during coating and physical defects in the coated photographic material. These problems have been described previously in the prior art. U.S. Pat. No. 5,300,394 to Miller et al. describes the use of fluorinated surfactants as a grinding aid for preparing solid-particle dispersions of filter dyes and other materials with improved stability to particle growth. However, this reference does not address the problem of filter dye crystal growth in the presence of an oxidized developer scavenger dispersion. This problem is addressed in U.S. Pat. No. 5,468,598 to Miller et al. in which solid particle dispersions are prepared in the presence of hydrophobic, water-soluble or water-dispersible polymers and are stable to particle growth in the presence of coating compositions also containing oxidized developer scavengers. However, it is not always possible to use such hydrophobic polymers in coating compositions because they may alter the viscosity of the coating composition if gelatin is present. The problem of crystal growth is also addressed in U.S. Pat. No. 5,360,702 to Zengerle et al. in which dispersion formulations having a specified relationship between the amounts of oxidized developer scavengers and solvents and types of solvents were used to reduce filter dye crystal growth. The entire disclosure of U.S. Pat. No. 5,360,702 is incorporated herein by reference. Although this approach led to substantially reduced crystallization, some filter-plugging continues to be experienced, especially with large-scale melts employed in manufacturing. It is therefore desirable to provide a coating composition containing a yellow filter dye and an oxidized developer scavenger that prevents the formation of large filter dye crystals which cause filter-plugging and physical defects when the coating composition is held at elevated temperatures for extended time periods prior to coating. It is toward this end that the present invention is directed.

SUMMARY OF THE INVENTION

The crystallization of the yellow filter dye in a coating composition which also contains an oxidized developer scavenger can be avoided by using a yellow filter dye represented by Formula I:

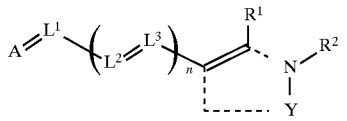

(I)

wherein

A=an acidic nucleus selected from the group consisting of benzoylacetonitrile, 2-phenyl-1,1,3-tricyanopropene, 5-pyrazolone, isooxazolone, barbituric acid, thiobarbituric acid, rhodanine, hydantoin, thiohydantoin, oxazolidindione, pyrazolidindione, indandione, pyrazolopyridone, 1,2,3,4-tetrahydroquinolin-2,4-dione, 3-oxo-2,3-dihydrobenzo[d]thiophene-1,1-dioxide and 3-dicynaomethine-2,3-dihydroxybenzo[d] thiophene-1,1dioxide;

$L^{1-3}$=each independently represents a substituted or unsubstituted methine group;

n=0 or 1;

$R^{1-2}$=each independently represents hydrogen or an alkyl, aryl or acyl groups (including alkoxycarbonyl, amido and carboxyl);

Y=non-metal atoms which form a five membered heterocyclic ring optionally comprising a fused substituted or unsubstituted benzene ring; and wherein the dye comprises at least one ionizable group with a pKa value between 4–11 such as a carboxyl group, a sulfonamido group or a sulfamoyl group;

or a filter dye of Formula II:

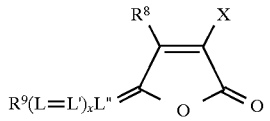

(II)

wherein $R^8$ is substituted or unsubstituted alkyl or aryl;

$R^9$ is substituted or unsubstituted alkyl or aryl or a substituted or unsubstituted aromatic heterocyclic nucleus; and X is an electron withdrawing group;

L, L', and L" are each independently a substituted or unsubstituted methine group; and x is 0 or a positive interger of from 1 to 6;

and a hydrazide oxidized developer scavenger of Formula III:

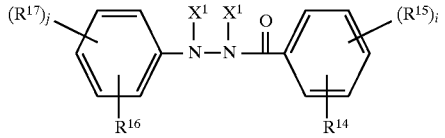

(III)

wherein $x^1$=hydrogen or a process cleavable group;

$R^{14}$=an electron withdrawing and aqueous solubilizing group;

$R^{15}$=a substituent group;

$R^{16}$=a ballasting group;

$R^{17}$=a substituent group;

i=1, 2, 3, or 4; and j=1, 2, 3, or 4.

ADVANTAGEOUS EFFECT OF THE INVENTION

The combination of the filter dye of Formula I or Formula II with the oxidized developer scavenger of Formula III provides a stable photographic coating composition which does not suffer from large crystal growth when held at elevated temperatures for extended periods of time. This allows these coating compositions to be readily passed through filters without plugging. The absence of large crystals avoids physical defects in the final coated photographic element.

DETAILED DESCRIPTION OF THE INVENTION

Figure 1:
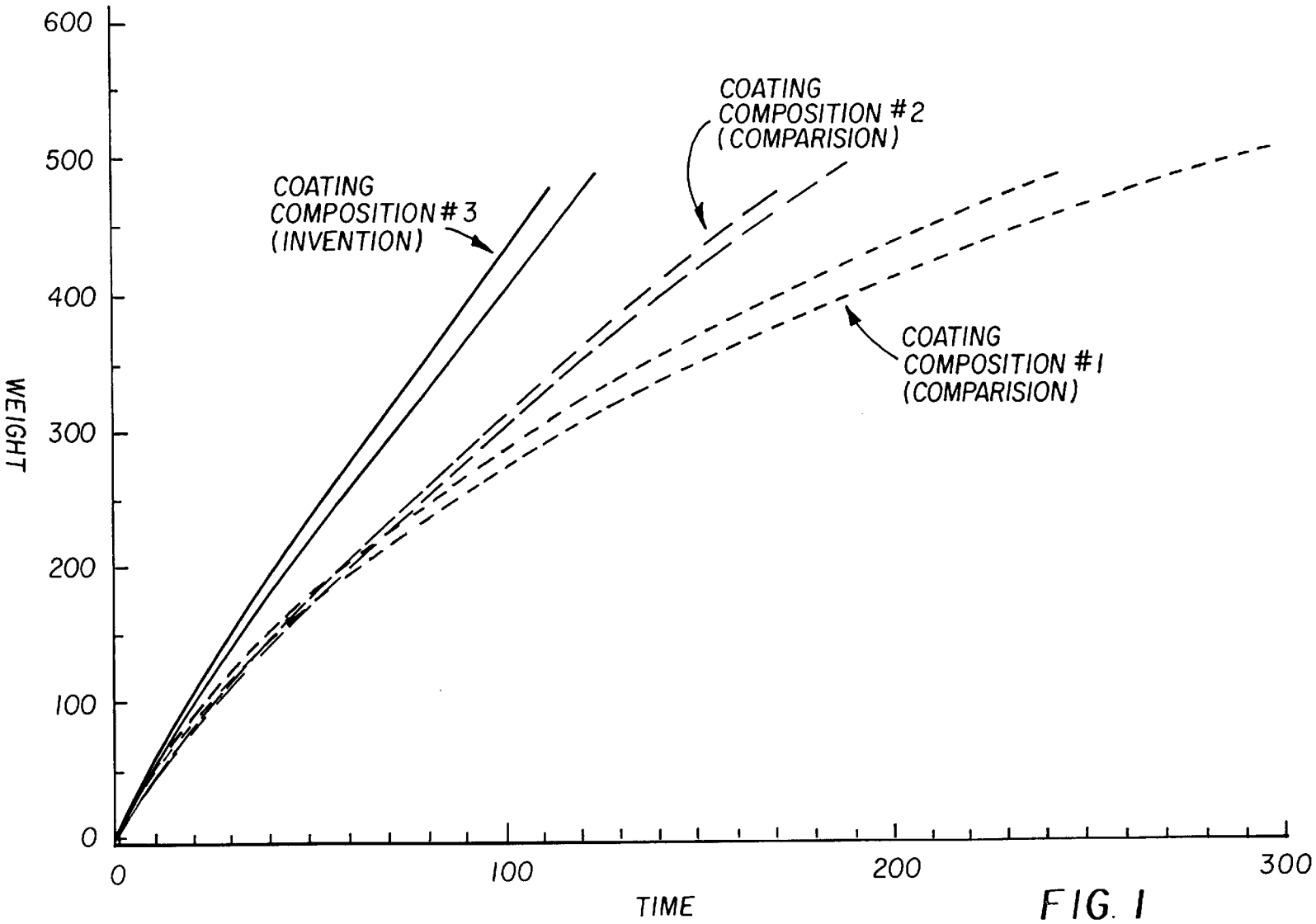
FIG. 1 and FIG. 2 are graphs demonstrating the improvement in filterability of coating compositions of this invention compared to prior art coating compositions, as set forth in Example 1 below.

The dyes of Formula I are described in detail as follows.

A in Formula I represents an acidic nucleus selected from the group consisting of benzoylacetonitrile, 2-phenyl-1,1,3-tricyanopropene, 5-pyrazolone, isooxazolone, barbituric acid, thiobarbituric acid, rhodanine, hydantoin, thiohydantoin, oxazolidindione, pyrazolidindione, indandione, pyrazolopyridone, 1,2,3,4-tetrahydroquinolin-2,4-dione, 3-oxo-2,3-dihydrobenzo[d]thiophene-1,1-dioxide and 3-dicynaomethine-2,3-dihydroxybenzo[d] thiophene-1,1-dioxide. The acidic nucleus is preferably selected from the group consisting of benzoylacetonitrile, 2-phenyl-1,1,3-tricyanopropene, 5-pyrazolone, isooxazolone, barbituric acid, oxazolidindione, pyrazolidindione, indandione and pyrazolopyridone nuclei. The acidic nucleus may have a substituent.

$L^1$, $L^2$ and $L^3$ in Formula I each independently represents substituted or unsubstituted methine groups. Preferable substituents for $L^{1-3}$ are alkyl groups of between 1 and 6 carbons. Other useful substituents for $L^{1-3}$ include those listed below for $R^3$ (discussed below with regard to Formula Ia). In Formula I, n represents 0 or 1 with 0 being preferred.

Y in Formula I represents non-metal atoms which may be assembled to form a five membered heterocylic ring optionally comprising a fused substituted or unsubstituted benzene ring. Heterocyclic rings formed by Y are selected from the group consisting of pyrrole, indole, pyrazole, pyrazolopyrimidone and benzindole. Dyes in which Y is an indole ring, a benzindole ring or a pyrrole are preferred. $R^1$ and $R^2$ each independently represents hydrogen, alkyl, aryl or acyl groups (including alkoxycarbonyl, amido and carboxy).

The dye described by Formula I also comprises at least one ionizable group with a pKa value between 4–11 such as a carboxyl group, a sulfonamido group or a sulfamoyl group. Preferably, this group is a carboxy (—$CO_2H$) or sulfonamido group (—$NHSO_2R'$, where R' is a substituted alkyl or aryl group as described for $R^3$ below).

In a preferred/another embodiment, the objectives and advantages of the invention are met by photographic elements wherein the dye according to Formula I has Formula Ia:

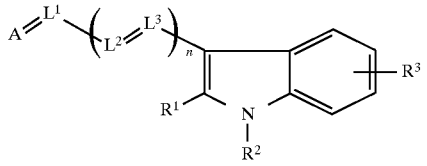

(Ia)

wherein

A=an acidic nucleus selected from the group consisting of benzoylacetonitrile, 2-phenyl-1,1,3-tricyanopropene, 5-pyrazolone, isooxazolone, barbituric acid, thiobarbituric acid, rhodanine, hydantoin, thiohydantoin, oxazolidindione, pyrazolidindione, indandione, pyrazolopyridone, 1,2,3,4-tetrahydroquinolin-2,4-dione, 3-oxo-2,3-dihydrobenzo[d]thiophene-1,1-dioxide and 3-dicynaomethine-2,3-dihydroxybenzo[d]thiophene-1,1-dioxide;

$L^{1-3}$=each independently represents a substituted or unsubstituted methine group;

n=0 or 1;

$R^{1-2}$=each independently represents hydrogen or an alkyl, aryl or acyl groups (including alkoxycarbonyl, amido and carboxyl); and $R^3$=hydrogen or a substituent group and wherein the dye comprises at least one ionizable group with a pKa value between 4–11 such as a carboxyl group, a sulfonamido group or a sulfamoyl group.

The groups A, $L^1$, $L^2$, $L^3$, $R^1$, and $R^2$ are described in greater detail above. The $R^3$ substituent group in Formula Ia can be substituted or unsubstituted alkyl, substituted or unsubstituted aryl or arlyoxy, or may be one of the following substituents including hydrogen, halogen, cyano, amino, alkoxy, alkoxycarbonyl, amido, acyl, alkylamino, carboxy, sulfonamido, sulfamoyl or hydroxy. When $R^3$ is an alkyl or aryl group, it may be optionally substituted with one of the substituents listed above. The alkyl or aryl groups may be substituted with any of a number of substituents as is known in the art, other than those such as sulfo substituents, that would tend to increase the solubility of the dye so much as to cause it to become soluble at coating pH's. Examples of alkyl groups include methyl, ethyl, n-propyl, n-hexyl or isohexyl. Examples of substituted alkyl groups include, for example, methoxyethyl, hydroxymethyl, etc. Examples of alkoxy groups include, for example, methoxy, ethoxy, butoxy. Examples of aryl groups include phenyl, naphthyl, anthracenyl, pyridyl and styryl. Examples of substituted aryl groups include, for example, tolyl, m-cholrophenyl, p-methanesulfonylphenyl, etc.

In a preferred/another embodiment, the objectives and advantages of the invention are met by photographic elements wherein the dye according to Formula I has Formula Ib:

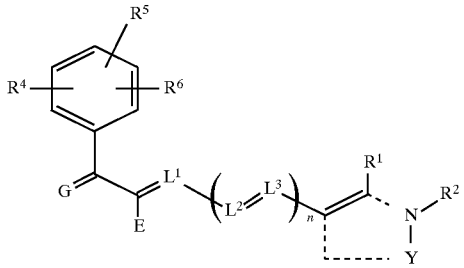

(Ib)

wherein $R^{4-6}$=each independently represents hydrogen or a substituent group;

G=O or dicyanovinyl (—$C(CN)_2$);

E=an electron withdrawing group;

$L^{1-3}$=each independently represents a substituted or unsubstituted methine group;

n=0 or 1;

$R^{1-2}$=each independently represents hydrogen or an alkyl, aryl or acyl groups (including alkoxycarbonyl, amido and carboxyl);

Y=non-metal atoms which form a five membered heterocyclic ring optionally comprising a fused substituted or unsubstituted benzene ring; and wherein the dye comprises at least one ionizable group with a pKa value between 4–11 such as a carboxyl group, a sulfonamido group or a sulfamoyl group.

The groups $L^1$, $L^2$, $L^3$, $R^1$, $R^2$ and Y are described in greater detail above. The substituent groups $R^4$, $R^5$ and $R^6$ can each independently be any of the groups described for $R^3$ above. The group E in Formula Ib is an electron withdrawing group. Electron withdrawing groups in organic compounds are well known in the art, such as described by March, Advanced Organic Chemistry, 3rd Ed., p. 238, the disclosure of which is incorporated herein by reference in its entirety. Examples of such groups include cyano, acyl, aminocarbonyl and alkoxycarbonyl. In a preferred embodiment, E is cyano.

In a preferred/another embodiment, the objectives and advantages of the invention are met by photographic elements wherein the dye according to Formula I has Formula Ic:

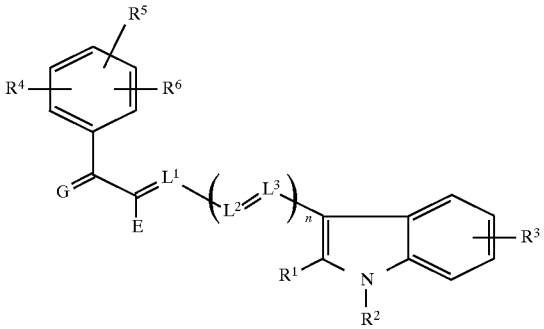

(Ic)

wherein $R^{4-6}$=each independently represents a hydrogen or a substituent group;

G=O or dicyanovinyl (—$C(CN)_2$);

E=an electron withdrawing group;

$L^{1-3}$=each independently represents a substituted or unsubstituted methine group;

n=0 or 1;

$R^{1-2}$=each independently represents hydrogen or an alkyl, aryl or acyl groups (including alkoxycarbonyl, amido and carboxyl);

$R^3$=hydrogen or a substituent group and wherein the dye comprises at least one ionizable group with a pKa value between 4–11 such as a carboxyl group, a sulfonamido group or a sulfamoyl group.

The groups $R^4$, $R^5$, $R^6$, G, E, $L^1$, $L^2$, $L^3$, $R^1$, $R^2$ and $R^3$ are described in greater detail above.

Representative examples of the yellow filter dyes of the present invention are shown below.

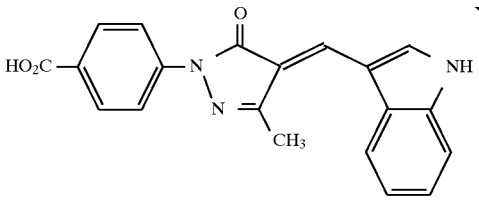

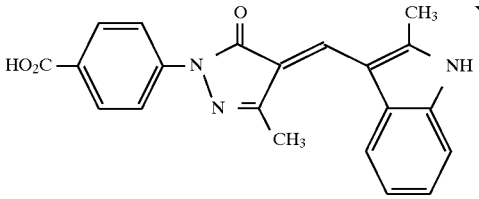

-continued

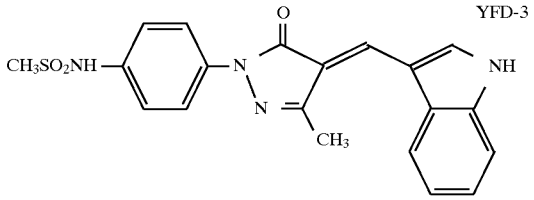

The yellow filter dyes of the present invention described in Table I refer to the generic structure shown below.

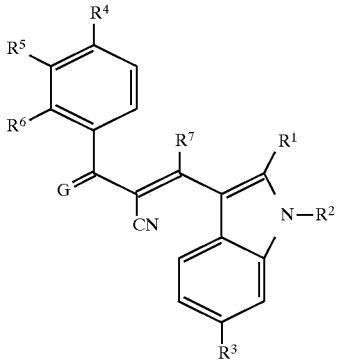

TABLE I

| YFD'S | $R^4$ | $R^5$ | $R^6$ | $R^1$ | $R^2$ | $R^7$ | $R^3$ | G |
|---|---|---|---|---|---|---|---|---|
| YFD 4 | $NHSO_2CH_3$ | H | H | H | H | H | H | O |
| YFD 5 | COOH | H | H | H | H | H | H | O |
| YFD 6 | $NHSO_2CH_3$ | H | H | H | H | H | H | $C(CN)_2$ |
| YFD 7 | $NHSO_2C_3H_7$ | H | H | H | H | H | H | O |
| YFD 8 | $NHSO_2CH_3$ | H | H | $CH_3$ | H | H | H | O |
| YFD 9 | $NHSO_2C_2H_5$ | H | H | $CH_3$ | H | H | H | O |
| YFD 10 | $NHSO_2C_3H_7$ | H | H | $CH_3$ | H | H | H | O |
| YFD 11 | $NHSO_2C_4H_9$ | H | H | $CH_3$ | H | H | H | O |
| YFD 12 | $NHSO_2C_4H_9$ | H | H | H | H | H | $CO_2CH_3$ | o |
| YFD 13 | $NHSO_2CH_3$ | H | H | H | $CH_3$ | H | H | O |
| YFD 14 | $NHSO_2CH_3$ | H | H | $CH_3$ | H | H | H | $C(CN)_2$ |
| YFD 15 | $NHSO_2CH_3$ | H | H | H | H | H | $CO_2CH_3$ | O |
| YFD 16 | COOH | H | H | H | H | H | H | $C(CN)_2$ |
| YFD 17 | H | H | H | H | H | H | H | O |
| YFD 18 | H | $NHSO_2CH_3$ | H | $CH_3$ | H | H | H | O |
| YFD 19 | $NHSO_2CH_3$ | H | H | $CH_3$ | $CH_3$ | H | H | O |
| YFD 20 | H | $NHSO_2CH_3$ | H | H | H | H | H | O |
| YFD 21 | $CO_2CH_3$ | H | H | H | H | H | H | O |
| YFD 22 | H | COOH | H | H | H | H | H | O |
| YFD 23 | H | COOH | H | $CH_3$ | $CH_3$ | H | H | O |
| YFD 24 | COOH | H | H | H | H | $CH_3$ | H | O |
| YFD 25 | COOH | H | H | H | H | H | COOH | O |
| YFD 26 | $NHSO_2CH_3$ | H | H | H | H | H | COOH | O |
| YFD 27 | OH | H | H | H | H | H | H | O |
| YFD 28 | OH | OH | H | $CH_3$ | $CH_3$ | H | H | O |
| YFD 29 | $SO_2NHCH_3$ | H | H | H | H | H | $CO_2CH_3$ | O |
| YFD 30 | OH | H | OH | H | H | H | H | O |

The dyes of Formula II are described in detail below.

According to Formula II, $R^8$ is substituted or unsubstituted alkyl or aryl. Preferred alkyl groups include alkyl of from 1 to 20 carbon atoms, including straight chain such as methyl, ethyl, propyl, butyl, pentyl, decyl, dodecyl, and so on, branched alkyl groups such as isopropyl, isobutyl, t-butyl, and the like. These alkyl groups may be substituted with any of a number of known substituents, such as sulfo, sulfato, sulfonamide, amido, amino, carboxyl, halogen, alkoxy, hydroxy, phenyl, and the like. The substituents may be located essentially anywhere on the alkyl group. The possible substituents are not limited to those exemplified, and one skilled in the art could easily choose from a number of substituted alkyl groups that would provide useful compounds according to Formula II.

Preferred aryl groups for $R^8$ include aryl of from 6 to 10 carbon atoms (e.g., phenyl, naphthyl), which may be substituted. Useful substituents for the aryl group include any of a number of known substituents for aryl groups, such as sulfo, sulfato, sulfonamido (e.g., butanesulfonamido), amido, amino, carboxyl, halogen, alkoxy, hydroxy, acyl phenyl, alkyl, and the like. Additionally, the aryl group may have substituents that form fused ring systems with it, such as naphthyl. The substituents can be located essentially anywhere on the ring. The possible substituents are not limited to those exemplified, and one skilled in the art could easily choose from a number of substituted aryl groups that would provide useful compounds according to Formula II.

X represents an electron withdrawing group. Electron withdrawing groups in organic compounds are well-known in the art, such as described in J. Marsh, advanced Organic Chemistry, 3rd Ed., p 238, the disclosure of which is incorporated herein by reference in its entirety. Useful electron withdrawing groups include, for example, cyano, substituted or unsubstituted carboxylate (preferably of from 2 to 7 carbon atoms, e.g., $CO_2R''$ where R" is substituted or unsubstituted alkyl or aralkyl), and —CO—R"' where R"' is primary or secondary amino, and aryl (either unsubstituted or substituted with an electron withdrawing group, e.g., phenyl, p-nitrophenyl, p-cyanophenyl, 3,4-dichlorophenyl). The possible substituents for the various X and R" groups will be known to those skilled in the art and include those described herein for $R^8$ and $R^9$.

$R^9$ represents aryl, preferably of from 6 to 10 carbon atoms, which may be substituted, as described above with respect to $R^8$, or a substituted or unsubstituted aromatic heterocyclic ring, preferably a 5- or 6-membered ring, which may be fused with another ring system. When $R^9$ is a 6-membered heterocyclic ring, the ring preferably contains at least one nitrogen atom. Examples of useful aromatic heterocyclic rings include furan, thiophene, pyridine, pyrrole, and imidazole. These rings may be substituted as described with respect to the aryl groups. In one preferred embodiment, $R^9$ is substituted or unsubstituted with an electron donor group. Electron donor groups for organic compounds are well known in the art, as described in the above-referenced Marsh, *Advanced Organic Chemistry*, 3rd Ed. and include, for example alkoxy, aryloxy, —$NHCOR^{10}$ where $R^{10}$ is alkyl or aryl, —$OCOR^{11}$ where $R^{11}$ is alkyl or aryl, and —$SR^{12}$ where $R^{12}$ is alkyl or aryl.

In preferred embodiment, $R^8$, $R^9$, or X may be substituted with at least one solubilizing group. This enables the dyes to be solubilized and removed and/or decolorized during processing so as to minimize dye stain caused by residual dye. Such solubilizing groups are known in the art and include, for example sulfonate (e.g., $SO_3Na$), sulfato, carboxy salts (e.g., $CO_2Na$), and the like. In an especially preferred embodiment, the solubilizing group comprises an ionizable proton (e.g., $CO_2H$, $NHSO_2R^{13}$ where $R^{13}$ is substituted alkyl of from 1 to 12 carbon atoms or substituted or unsubstituted aryl of from 6 to 12 carbon atoms. Such ionizable protons tend to cause the dyes of Formula II to be insoluble at acid to neutral coating pH's and soluble at neutral to basic processing pH's. Dyes according to Formula II comprising such ionizable protons are well-adapted to use in photographic elements in the form of solid particle dispersions, described below.

In a preferred embodiment of the invention, the dye of Formula II is a yellow filter dye where n is 0 and $R^9$ is selected from the group consisting of furan, methylfuran, pyrrole, aryl, and thiophene. Examples of dyes of Formula II are:

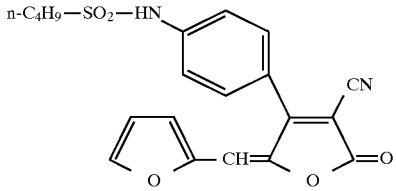

YFD-31

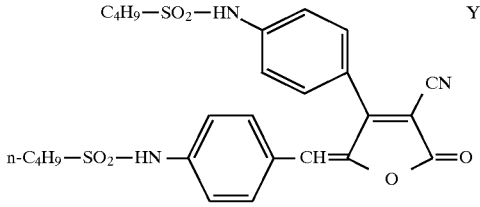

YFD-32

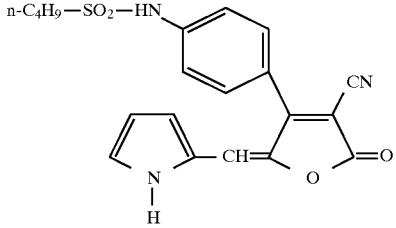

YFD-33

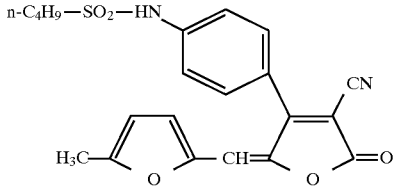

YFD-34

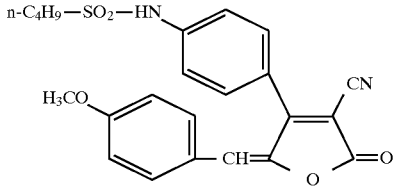

YFD-35

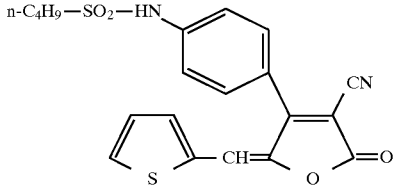

YFD-36

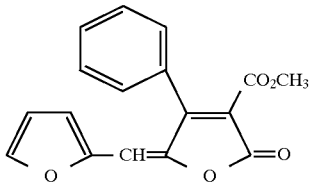

YFD-37 and

-continued

YFD-38

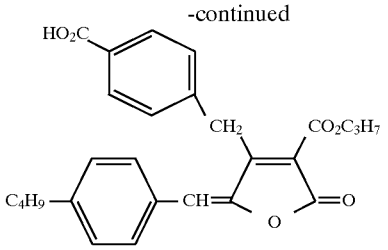

The filter dyes of the present invention can be incorporated into the photographic element in any of the ways known in the art. They may be added directly to, or dispersed in film-forming polymeric vehicles and/or binders, as is well known in the art. These include both naturally occurring and synthetic binders, such as gelatin and gelatin derivatives, polyvinyl alcohols, acrylamide polymers, polyvinyl acetates, polyacrylates, and the like. In certain instances, especially where the dye is mobile, (e.g., a dye with one or more $SO_3$ constituients) it may be advantageous to use the dye in combination with a mordant, such as polyvinylimidizole and polyvinylpyridine, to aid in immobilizing the dye. The technology of mordanting dyes is well known in the art, and is described in further detail in Jones et al U.S. Pat. No. 3,282,699 and Heseltine et al U.S. Pat. Nos. 3,255,693 and 3,438,779. An oil-in-water dispersion of the dye may be prepared by dissolving the dye in an organic liquid, forming a premix with an aqueous phase containing dispersing aids such as water-soluble surfactants, polymers and film-forming binders such as gelatin, and passing through a mill until the desired particle size is obtained. The mill can be any high energy device such as a colloid mill, high pressure homogenizer, ultrasonic device, or the like. Preparation of conventional oil-in-water dispersions are well known in the art and are described in further detail in Jelly and Vittum U.S. Pat. No. 2,322,027. The dyes can also be loaded into a latex polymer, either during or after polymerization, and the latex can be dispersed in a binder. Additional disclosure of loaded latices can be found in Milliken U.S. Pat. No. 3,418,127.

In a preferred embodiment, the dye is dispersed in the binder in the form of a solid particle dispersion. Such dispersions are formed by either milling the dye in solid form until the desired particle size range is reached, or by precipitating the dye directly in the form of a solid particle dispersion. In the case of solid particle milling dispersal methods, a coarse aqueous premix, containing the filter dye and water, and optionally, any desired combination of water soluble surfactants and polymers, is made, and added to this premix prior to the milling operation. The resulting mixture is then loaded into a mill. The mill can be, for example, a ball mill, media mill, jet mill, attritor mill, vibratory mill, or the like. The mill is charged with the appropriate milling media such as, for example, beads of silica, silicon nitride, sand, zirconium oxide, yittria-stabilized zirconium oxide, alumina, titanium, glass, polystyrene, etc. The bead sizes typically range from 0.25 to 3.0 mm in diameter, but small media may be used if desired. The solid dye particles in the slurry are subjected to repeated collisions with the milling media, resulting in crystal fracture and consequent particle size reduction. The solid particle dispersions of the dye should have an average particle size of 0.01 to about 10 microns, preferably 0.05 to about 3 microns. Most preferably, the solid particles are of a sub-micron average size. In the case of pH precipitation techniques, an aqueous solution of the dye is made at relatively high pH, then the pH is lowered to cause precipitation of the dye. The aqueous dispersion can further contain appropriate surfactants and polymers previously disclosed for use in making pH precipitated dispersions. For solvent precipitation, a solution of the dye is made in some water miscible, organic solvent. The solution of the dye is added to an aqueous solution containing appropriate surfactants and polymers to cause precipitation as previously disclosed for use in making precipitated dispersions.

Surfactants and other additional conventional addenda may also be used in the dispersing process described herein in accordance with prior art solid particle dispersing procedures. Such surfactants, polymers and other addenda are disclosed in U.S. Pat. Nos. 5,468,598, 5,300,394, 5,278,037, 4,006,025, 4,294,916, 4,294,917, 4,940,654, 4,950,586, 4,927,744, 5,279,931, 5,158,863, 5,135,844, 5,091,296, 5,089,380, 5,103,640, 4,990,431, 4,970,139, 5,256,527, 5,015,564, 5,008,179, 4,957,857, and 2,870,012, and British Patent Nos. 1,570,362 and 1,131,179 referenced above, the disclosures of which are hereby incorporated by reference, in the dispersing process of the filter dyes.

Additional surfactants or other water soluble polymers may be added after the formation of the filter dye dispersion, before or after subsequent addition of the small particle dispersion to an aqueous coating medium for coating onto a photographic element support. The aqueous medium preferably contains other compounds such as stabilizers and dispersants, for example, additional anionic, nonionic, zwitterionic, or cationic surfactants, and water soluble binders such as gelatin as is well known in the art. This aqueous coating medium may further contain other dispersions or emulsions of compounds useful in imaging.

The filter dyes described are present in a layer of the photographic element in an amount to be effective as a photographic filter dye, as would be known to one skilled in the art. The filter dye is preferably present in an amount of from 1 to 2000 mg/m2 and more preferably on an amount of from 25 to 500 mg/m2. The dye preferably provides an optical density of 0.1 to 3.0 density units at its lambda-max.

The photographic compositions and elements according to the present invention also contain a hydrazide oxidized developer scavenger. The oxidized developer scavenger compounds used in the present invention can be prepared by reactions known in the art using existing technology as described for example in U.S. Pat. No. 4,923,787 to Harder and co-pending commonly assigned U.S. patent application Ser. No. 08/373,131, filed Jan. 17, 1995, the entire disclosure of which is incorporated herein by reference. Preferred hydrazide oxidized developer scavengers of Formula III are described in detail as follows.

The $X^1$ groups of Formula III, which may be the same or different, each represents hydrogen atoms or one represents hydrogen and the other represents a process cleavable group. A process cleavable group is a group which undergoes a fragmentation or reaction breaking the bond between the group and the nitrogen atom of the hydrazide during the color development step of the photographic process or in one of the processing solutions prior to the color developer. Examples include $C_1$–$C_{30}$ alkylsulfonyl, $C_6$–$C_{30}$ arylsulfonyl and $C_1$–$C_{30}$ acyl groups. Preferably, the $X^1$ groups may be hydrogen, alkylsulfonyl groups and arylsulfonyl groups which have not more than 20 carbon atoms (phenylsulfonyl and substituted phenylsulfonyl groups in which the sum of the Hammett substituent constants is at least −0.5 are more preferred), or acyl groups which have not more than 20 carbons (benzoyl, substituted benzoyl groups in which the sum of the Hammett substituent constants is at least −0.5, or linear chain, branched or cyclic unsubstituted or substituted aliphatic acyl groups which have, for example, halogen, ether, sulfonamido, carbonamido, hydroxyl, carboxyl, sulfonic acid groups as substituent groups are more preferred). The $X^1$ groups are most preferably hydrogen atoms.

The electron withdrawing and aqueous solubilizing group $R^{14}$ above is a group both with a Hammett sigma p value greater than 0.10 (the reference for all Hammett sigma p values in this patent is C. Hansch and A. J. Leo, *Substituent Constants for Correlation Analysis in Chemistry*, Wiley, New York, 1979) and with intrinsic hydrophilicity or the capability of substantial ionization under processing conditions. For ionizable groups, the Hammett sigma p value should correspond the structure of the group at a pH value of 10 to simulate photographic processing conditions. Thus, while a carboxylic acid group has a Hammett sigma p value of 0.45, at a pH of 10 the group will be ionized to a carboxy anion which has a Hammett sigma p value of 0 (zero). Examples of the electron withdrawing and aqueous solubilizing group, $R^{14}$, include aminosulfonyl (Hammett sigma p=0.62) and aminocarbonyl (0.36) groups. Preferably, the $R^{14}$ group is an aminosulfonyl group. It is also preferred that the $R^{14}$ group be in the ortho position to the carbonyl of the hydrazide to maximize its influence on the hydrolysis of the intermediate azo species, formed during the reaction of the scavenger with oxidized developer, through both electronic effects and, for some substituents, through anchimeric assistance of the hydrolysis reaction. Representative examples of the electron withdrawing and solubilizing group, $R^{14}$, are shown below.

$—SO_2NH_2$, $—SO_2NHCOC_6H_5$, $—SO_2NHCH_3$, $—SO_2NHC_6H_5$, $—CONH_2$, $—CONHCH_3$, $—CONHC_6H_5$.

For group $R^{16}$ above, ballasting groups known in the art are suitable for the present invention. Preferably, they are groups which prevent substantial migration of the oxidized developer scavenger within the photographic element. Migration should be limited during both shelf keeping and processing. Preferably, the ballasting groups are large organic substituents containing at least 12, and more preferably at least 15, contiguous atoms and including substituted or unsubstituted alkyl, aryl or aralkyl groups. Representative substituents on such ballast groups include all those listed for substituent groups $R^{15}$ and $R^{17}$ below. Such substituents may also be further substituted. Representative examples of the ballast group, $R^{16}$, are shown below.

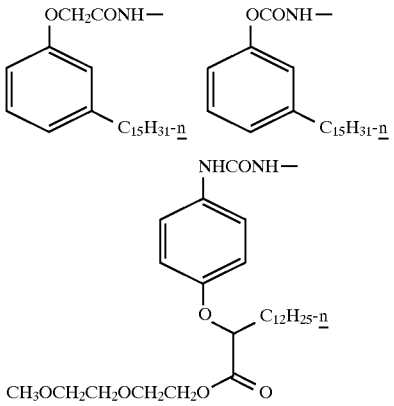

-continued

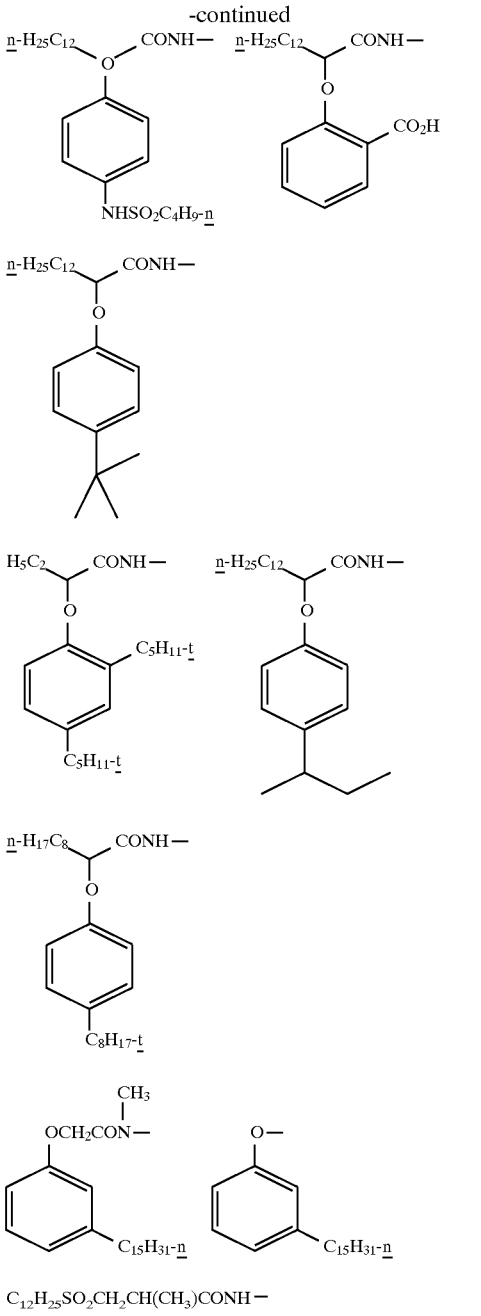

-continued

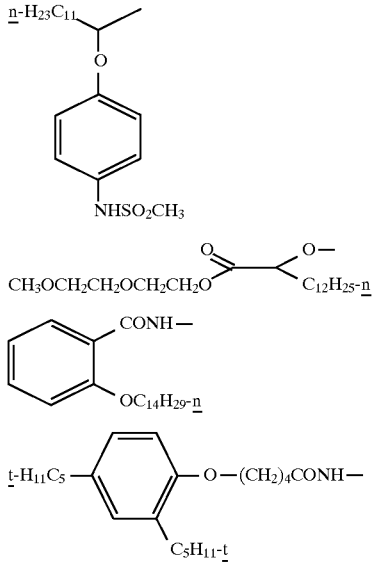

The aromatic ring linked to the carbonyl of the hydrazide may only be substituted with electron withdrawing group $R^{14}$ (as defined above), the remaining four positions on the ring being occupied by hydrogen atoms, or it may be additionally substituted by one or more substituents $R^{15}$. Likewise, the aromatic ring linked to the nitrogen of the hydrazide may only be substituted with ballast group $R^{16}$ (as defined above) or it may be additionally substituted by one or more substituent groups $R^{17}$.

The substituent groups $R^{15}$ and $R^{17}$, which may be the same or different, may be alkyl, cycloalkyl, alkenyl, cycloalkenyl, alkynyl, aryl, heteroaryl, heterocyclyl, alkoxy, heterocyclyloxy, aryloxy, siloxy, alkylthio, arylthio, heterocyclylthio, hydroxy, halogen, cyano, nitro, alkoxycarbonyl, alkoxycarbonylamino, aryloxycarbonyl, aryloxycarbonylamino, aminocarbonyl, carboxy, acyl, acyloxy, amino, alkylamino, anilino, imido, ureido, carbonamido, carbamoyl, carbamoyloxy, sulfonyl, aminosulfonyl, sulfinyl, sulfonamido, sulfamoyl, sulfamoylamino, phosphenyl, spiro compound residues, bridged hydrocarbon residues, and the like. It is preferred that there be at least one $R^{17}$ group and that this non-hydrogen substituent be an electron donating group with a Hammett sigma p value of 0 (zero) or less. Electron donating groups improve the activity of the hydrazide oxidized developer scavenger by making its oxidation more facile. Examples include carbonamido (Hammett sigma p for acetamido=0.00), aryl (−0.01), alkyl (methyl=−0.17, ethyl=−0.151), alkyloxy (methoxy=−0.27, ethoxy=−0.24), aryloxy (−0.32), amino (−0.66) and alkylamino (methylamino=−0.84, ethylamino=−0.61) groups. More preferably, the electron donating group is carbonamido, aryloxy or alkyloxy. It is further preferred that none of the $R^{17}$ groups be an electron withdrawing group as defined above for the $R^{14}$ group. It is also preferred that none of the $R^{15}$ groups be an electron donating group as defined above for the $R^{17}$ group.

The ballast group $R^{16}$ and the preferred electron donating group for $R^{17}$ may be combined into a single group by incorporating the ballasting group into the electron donating group. Examples include alkylamido, alkyl or alkyloxy groups in which the alkyl portion of the electron donating group contains at least 8, preferably at least 12, and more preferably at least 15 contiguous atoms. All of the examples shown for $R^{16}$ above are ballast groups which incorporate the preferred electron donating group.

The $R^{15}$, $R^{16}$ and $R^{17}$ groups may further comprise an aqueous solubilizing group as defined above for the $R^{14}$ group. Examples include carboxylic acids; sulfonamides; thiols; cyanamides; ureas; sulfonylureas; imides; sulfonic acids; polyethers having greater than 2 repeating units; amines and polyamines; cationic centers such as ammonium; sulfonium or phosphonium groups; amides such as carbonamides or phosphonamides; alcohols or polyalcohols; and salts thereof. The most preferred groups are selected from carboxy, carboxyalkyl, sulfo, sulfoalkyl, sulfonamides, phosphato, phosphatoalkyl, phosphono, phosphonoalkyl, carbonamido, sulfonamido, hydroxy, and salts thereof. While the hydrazide oxidized scavengers of the present invention include an aqueous solubilizing group, $R^{14}$, the presence of additional aqueous solubilizing groups may further increase the activity. The presence of an aqueous solubilizing group within the substituents $R^{15}$, $R^{16}$ and $R^{17}$ is preferred.

Preferably, the objectives of the present invention are accomplished with a hydrazide oxidized developer scavenger represented by Formula IIIa:

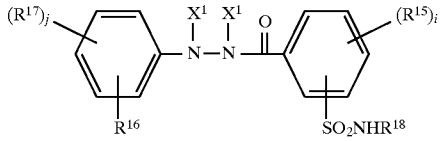

(IIIa)

wherein $R^{18}$=hydrogen, acyl, alkyl or aromatic substituent;

$X^1$, $R^{15}$, $R^{16}$, $R^{17}$, i and j are defined as above.

More preferably, the objectives of the present invention are accomplished with a hydrazide oxidized developer scavenger represented by Formula IIIb:

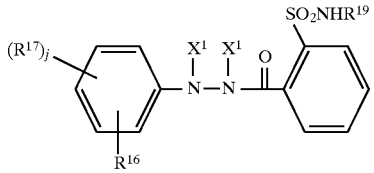

(IIIb)

wherein $R^{19}$=hydrogen or acyl substituent;

$X^1$, $R^{16}$, $R^{17}$, and j are defined as above.

Most preferably, the objectives of the present invention are accomplished with a hydrazide oxidized scavenger represented by Formula IIIc:

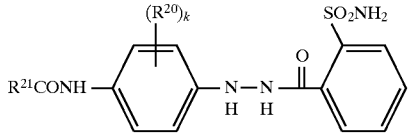

(IIIc)

wherein $R^{20}$=a substituent group;

$R^{21}$=a ballasting group; and k=1, 2, 3 or 4.

The substituent group $R^{20}$ may be any of the substituents described above for the $R^{15}$ and $R^{17}$ groups. It is further preferred that none of the $R^{20}$ groups be an electron withdrawing group as defined for the $R^{14}$ group. The ballasting group $R^{21}$ may be any of the ballasting groups defined above for the $R^{16}$ group.

Representative examples of the oxidized developer scavengers of the present invention are shown below.

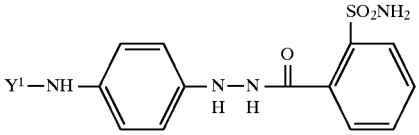
ODS 1: $Y^1$ =
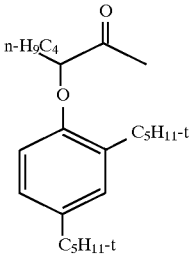
ODS 2: $Y^1$ =
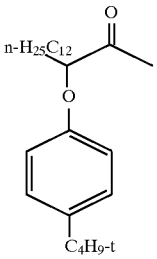
ODS 3: $Y^1$ =
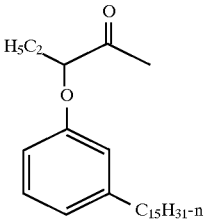
ODS 4: $Y^1$ =
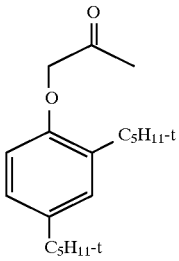
ODS 5: $Y^1$ =
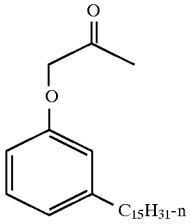
ODS 6: $Y^1$ =
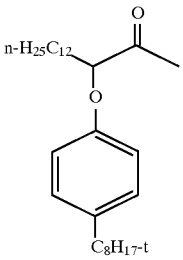
-continued
ODS 7: $Y^1$ =
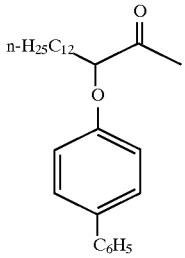
ODS 8: $Y^1$ =
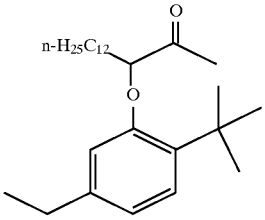
ODS 9: $Y^1$ =
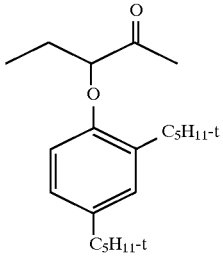
ODS 10: $Y^1$ =
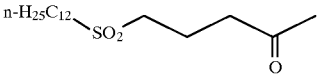
ODS 11:
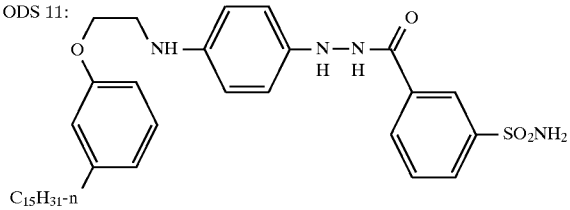
ODS 12:
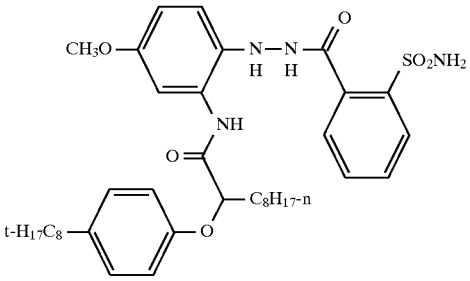
ODS 13:
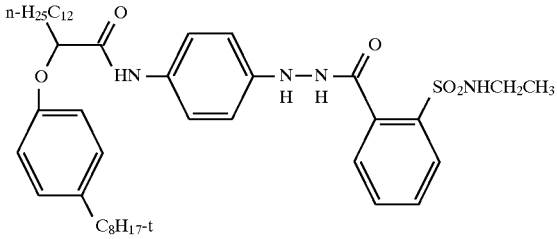

-continued
ODS 14:
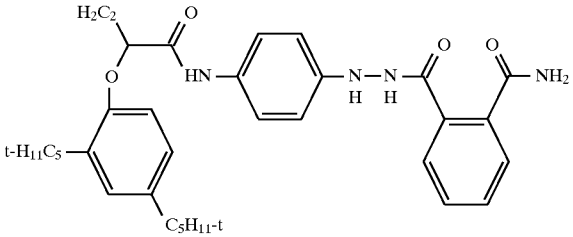
ODS 15:
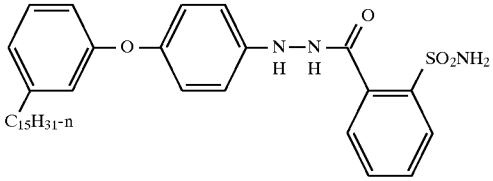
ODS 16:
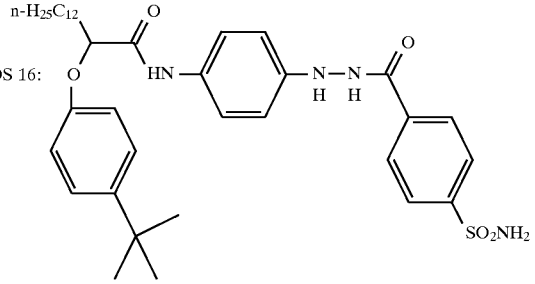
ODS 17:
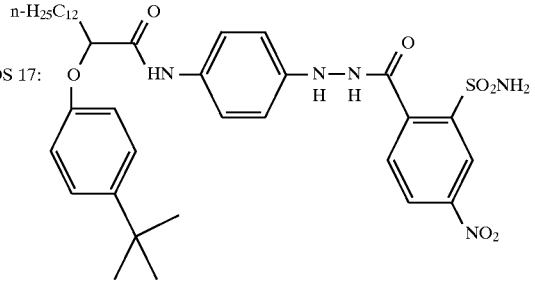
ODS 18:
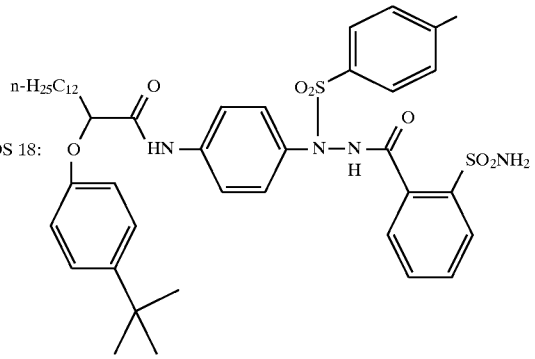
-continued
ODS 19:
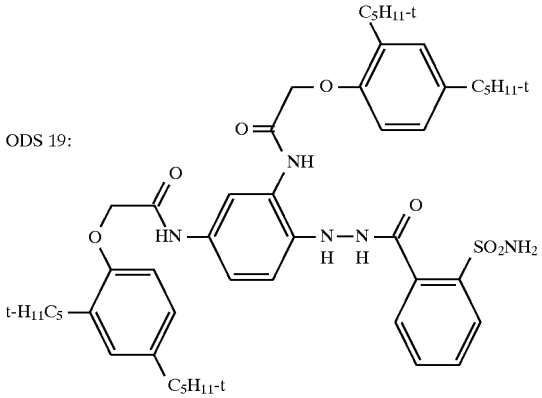
ODS 20:
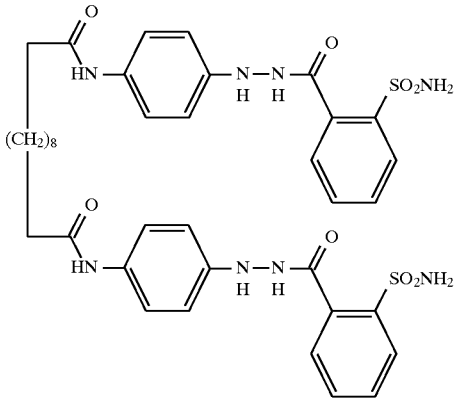
ODS 21:
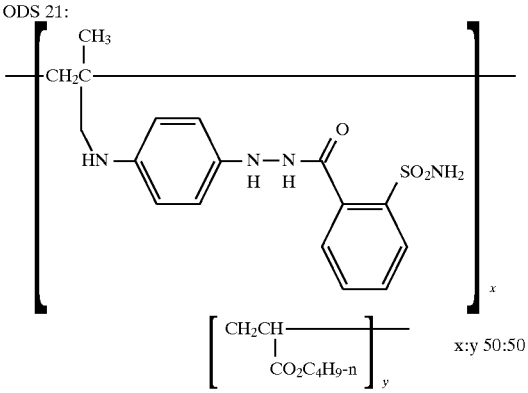
x:y 50:50
ODS 22:
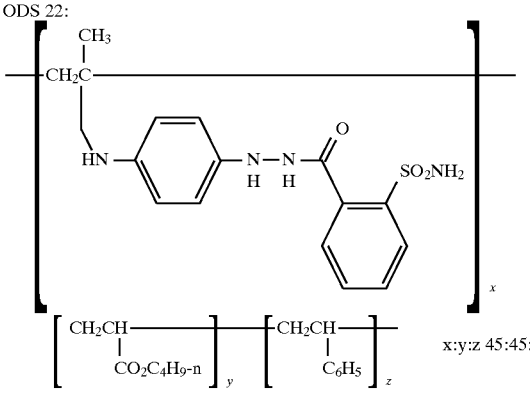
x:y:z 45:45:10
and -continued

ODS 23:

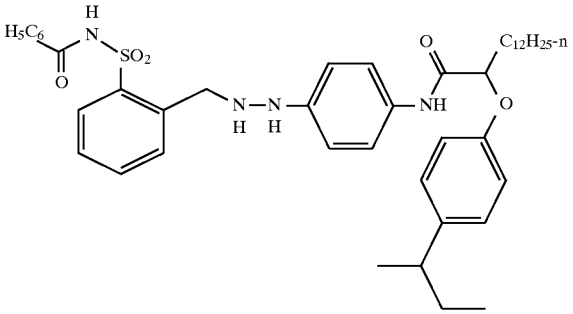

The oxidized developer scavenger (ODS) of Formula III is added to a coating composition (as discussed above) containing a yellow filer dye of Formula I or II. The ODS is preferably first dispersed in an aqueous medium comprising a binder such as those described above for yellow filter dye dispersions. The ODS dispersion is then combined with a filter dye dispersion to form a coating composition of this invention which can then be used to prepare a photographic element according to this invention.

The photographic elements made by the method of the present invention can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent (for example a cellulose acetate or polyester film support) or reflective (for example, a paper support).

A typical multilayer photographic element of this invention comprises:

A cellulose triacetate support provided with a subbing layer and coated with a plurality of layers having the compositions set forth below. In the composition of the layers, the coating amounts are shown as g/m$^2$.

| | |
|---|---|
| First Layer: Antihalation Layer | |
| Black Colloidal Silver | 0.43 (as silver) |
| UV Dye UV-1 | 0.04 |
| Dispersed in Solvent S-1 | 0.04 |
| Gelatin | 2.44 |
| Second Layer: Intermediate Layer | |
| Gelatin | 1.22 |
| Third Layer: Slow Red Sensitive Layer | |
| Silver Iodobromide Emulsion tabular emulsion (13:1 aspect ratio) 3% bulk iodide spectrally sensitized with dyes SD-1 and SD-2 | 0.25 (as silver) |
| Silver Iodobromide Emulsion tabular emulsion (6:1 aspect ratio) 4% bulk iodide spectrally sensitized with dyes SD-1 and SD-2 | 0.20 (as silver) |
| Silver Iodobromide Emulsion 0.15 $\mu$ equivalent spherical diameter 4.8% bulk iodide spectrally sensitized | 0.12 (as silver) |
| Fine Grain Silver Bromide 0.07 $\mu$ equivalent spherical diameter | 0.05 |
| Cyan Coupler C-1 | 0.23 |
| Dispersed in Solvent S-3 | 0.11 |
| Oxidized Developer Scavenger -ODS-2 | 0.03 |
| Dispersed in Solvent S-3 | 0.03 |
| Gelatin | 0.86 |
| Fourth Layer: Fast Red Sensitive Layer | |
| Silver Iodobromide Emulsion tabular emulsion (12:1 aspect ratio) 1.5% bulk iodide spectrally sensitized with dyes SD-1 and SD-2 | 0.68 (as silver) |
| Silver Iodobromide Emulsion 0.15 $\mu$ equivalent spherical diameter 4.8% bulk iodide spectrally sensitized | 0.12 (as silver) |
| Fine Grain Silver Bromide 0.07 $\mu$ equivalent spherical diameter | 0.08 |
| Cyan Coupler C-1 | 1.36 |
| Dispersed in Solvent S-3 | 0.68 |
| Gelatin | 2.15 |
| Fifth Layer: Interlayer | |
| Oxidized Developer Scavenger ODS-2 | 0.11 |
| Dispersed in Solvent S-3 | 0.11 |
| Inhibitor I-1 | 0.001 |
| Gelatin | 0.61 |

-continued

| | |
|---|---|
| Sixth Layer: Interlayer | |
| Filter Dye FD-1 | 0.06 |
| Gelatin | 0.61 |
| Seventh Layer: Slow Green Sensitive Layer | |
| Silver Iodobromide Emulsion tabular emulsion (7:1 aspect ratio) 3% bulk iodide spectrally sensitized with dyes SD-3 and SD-4 | 0.27 (as silver) |
| Silver Iodobromide Emulsion tabular emulsion (6:1 aspect ratio) 4% bulk iodide spectrally sensitized with dyes SD-3 and SD-4 | 0.22 (as silver) |
| Silver Iodobromide Emulsion 0.15 $\mu$ equivalent spherical diameter 4.8% bulk iodide spectrally sensitized | 0.11 (as silver) |
| Magenta Coupler M-1 | 0.05 |
| Magenta Coupler M-2 | 0.11 |
| Co-dispersed in Solvent S-2 | 0.08 |
| Gelatin | 0.86 |
| Eighth Layer: Fast Green Sensitive Layer | |
| Silver Iodobromide Emulsion tabular emulsion (11:1 aspect ratio) 2% bulk iodide spectrally sensitized with dyes SD-3 and SD-4 | 0.62 (as silver) |
| Silver Iodobromide Emulsion 0.15 $\mu$ equivalent spherical diameter 4.8% bulk iodide spectrally sensitized | 0.06 (as silver) |
| Magenta Coupler M-1 | 0.34 |
| Magenta Coupler M-2 | 0.78 |
| Co-dispersed in Solvent S-2 | 0.56 |
| Gelatin | 1.94 |
| Ninth Layer: Interlayer | |
| Oxidized Developer Scavenger ODS-2 | 0.11 |
| Dispersed in Solvent S-3 | 0.11 |
| Yellow Filter Dye YFD-4 | 0.22 |
| Gelatin | 0.61 |
| Tenth Layer: Slow Blue Sensitive Layer | |
| Silver Iodobromide Emulsion tabular emulsion (13:1 aspect ratio) 2% bulk iodide spectrally sensitized with dyes SD-5 and SD-6 | 0.48 (as silver) |
| Yellow Coupler YEL-1 | 0.48 |
| Dispersed in Solvent S-3 | 0.16 |
| Gelatin | 0.86 |
| Eleventh Layer: Fast Blue Sensitive Layer | |
| Silver Iodobromide Emulsion tabular emulsion (22:1 aspect ratio) 3% bulk iodide spectrally sensitized with dyes SD-7 and SD-8 | 0.65 (as silver) |
| Yellow Coupler YEL-1 | 1.66 |
| Dispersed in Solvent S-3 | 0.56 |
| Gelatin | 2.37 |
| Twelfth Layer: First Protective Layer | |
| UV Dye UV-2 | 0.38 |
| UV Dye UV-3 | 0.07 |
| UV Dye UV-1 | 0.13 |
| Dispersed in Latex L-1 | 0.65 |
| Oxidized Developer Scavenger ODS-2 | 0.06 |
| Dispersed in Solvent S-3 | 0.06 |
| Gelatin | 1.40 |
| Thirteenth Layer: Second Protective Layer | |
| Fine Grain Silver Bromide 0.07 $\mu$ equivalent spherical diameter | 0.12 (as silver) |
| Matte 3.3 $\mu$ spherical diameter | 0.02 |
| Hardener H-1 | 0.32 |
| Gelatin | 0.98 |

-continued
C-1:
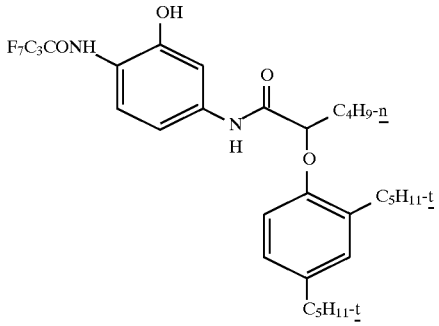
M-1:
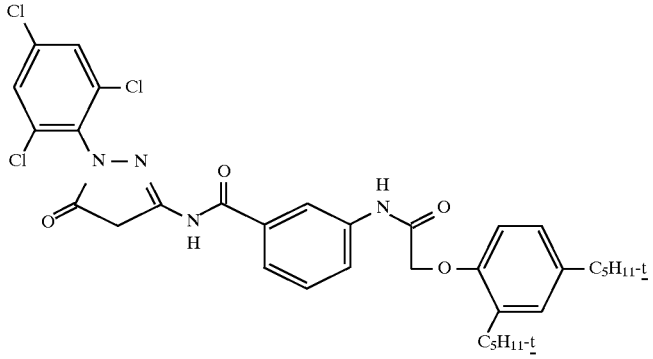
M-2:
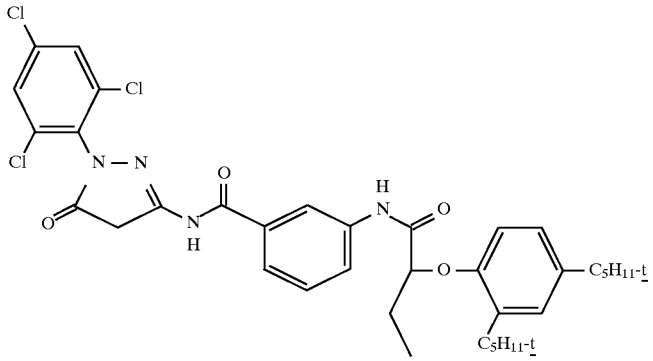
YEL-1:
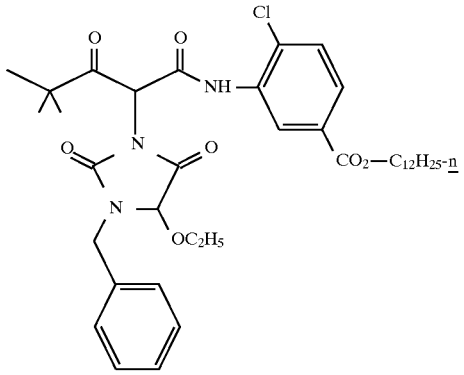
FD-1:
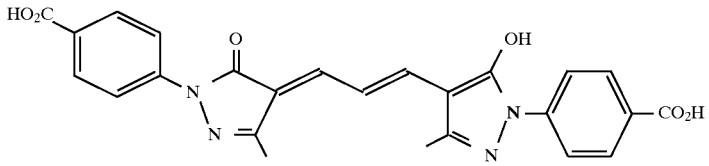

-continued
SD-1:
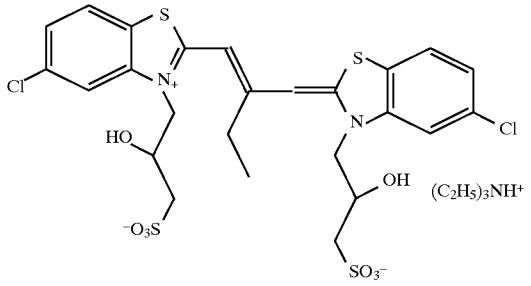
SD-2:
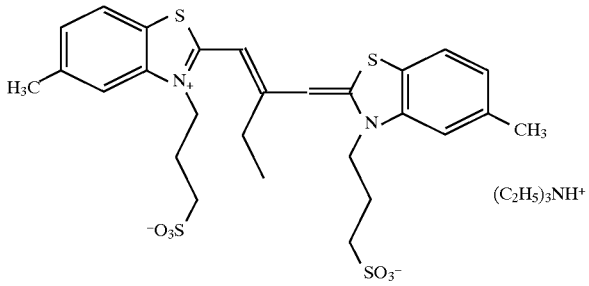
SD-3:
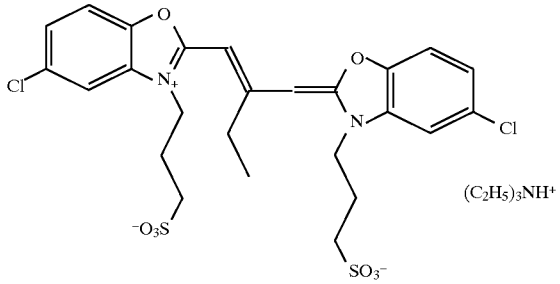
SD-4:
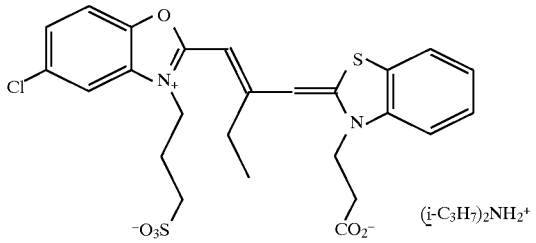
SD-5:
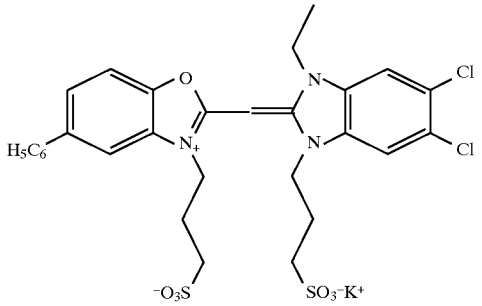

-continued
SD-6:
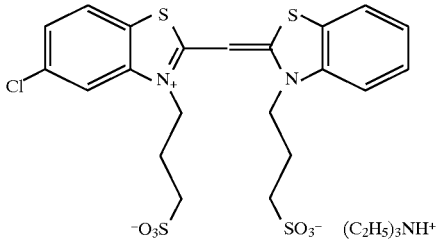
SD-7:
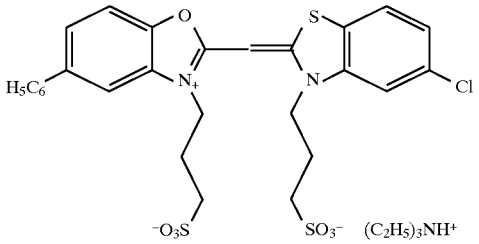
SD-8:
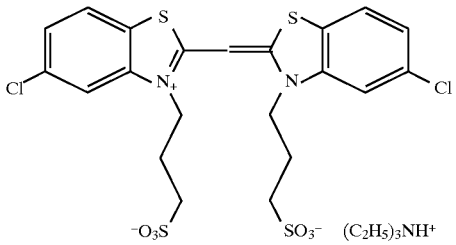
UV-1:
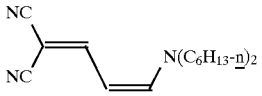
UV-2:
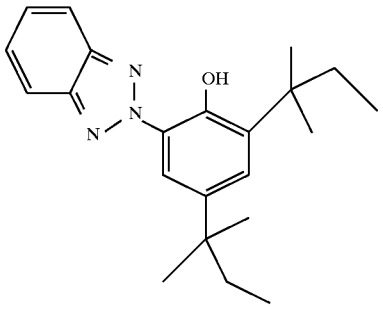
UV-3:
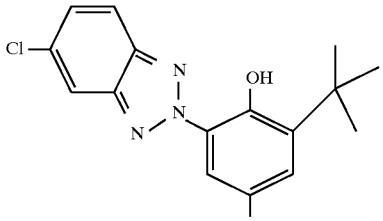
I-1:
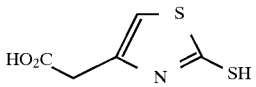

-continued

L-1:

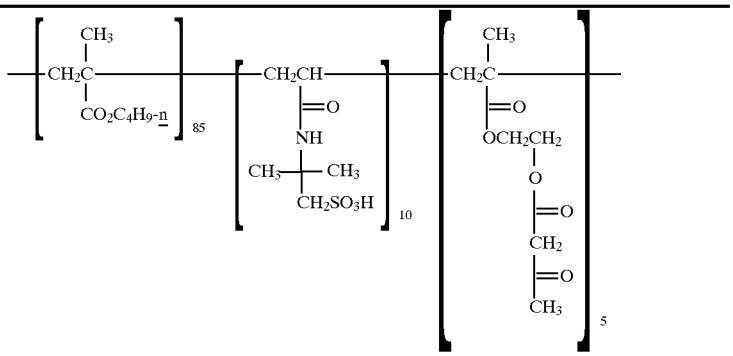

Hardener H-1

1,1'-[methylenebis(sulfonyl)]bis-ethene

Solvent S-1

1,4-Cyclohexylenedimethylene bis(2-ethylhexanoate)

Solvent S-2

Phosphoric acid, tris(methylphenyl) ester

Solvent S-3

1,2-Benzenedicarboxylic acid, dibutyl ester

Additional multilayer photographic elements and their components, useful for this invention are disclosed in Research Disclosure No. 370, Item 37038, February 1995, the disclosure of which is incorporated herein by reference.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1994, Number 365, Item 36544, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12*a* North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of internal latent image forming emulsions (that are either fogged in the element or fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor- Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12*a* North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like. For example, the silver halide used in the photographic elements of the present invention may contain at least 90% silver chloride or more (for example, at least 95%, 98%, 99% or 100% silver chloride). In the case of such high chloride silver halide emulsions, some silver bromide may be present but typically substantially no silver iodide. Substantially no silver iodide means the iodide concentration would be no more than 1%, and preferably less than 0.5 or 0.1%. In particular, in such a case the possibility is also contemplated that the silver chloride could be treated with a bromide source to increase its sensitivity, although the bulk concentration of bromide in the resulting emulsion will typically be no more than about 2 to 2.5% and preferably between about 0.6 to 1.2% (the remainder being silver chloride). The foregoing % figures are mole %.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 $\mu$m in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element.

Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl) aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

The following examples illustrate the use of an oxidized developer scavenger of Formula III with a yellow filter dye of Formula I or II.

EXAMPLE 1

A solid particle dispersion of YFD-31 was prepared by circulating a slurry containing 36% dye, 3.6% Triton X-200, a sodium salt of an alkylaryl polyether sulfonate surfactant from Rohm and Haas, and 61.4% distilled water through a Netzsch 60L media mill containing 54L of 0.4 mm SEPR ceramic beads until the final mean dispersion particle size was less than 1 micron. After milling, the slurry was added to a deionized gelatin solution to achieve a final concentration of 5% dye and 7% gelatin, called Dispersion A. A solid particle dispersion of YFD-4 was prepared by circulating a slurry containing 25% dye, 7.5% Ketjenlube 522 dispersant, a synthetic block copolymer from Akzo Chemicals, 1.25% Dowfax 2A1, a dodecyl benzene sulfonate surfactant from Dow Chemical, 2% Luviskol K-30, polyvinylpyrrolidone from BASF, and 64.25% distilled water through a Netzsch LME-2 media mill containing 2464 ml of 0.7 mm SEPR ceramic beads until the final dispersion mean particle size was less than 1 micron. After milling, the slurry was diluted to a concentration of 20% dye with distilled water, called Dispersion B.

An oxidized developer scavenger dispersion was prepared by dissolving 60.0 g of ODS-24 (formula given below) in 60.0 g of di-n-butylphthalate and 120.0 g of ethyl acetate at 60° C., then combining the resulting solution with an aqueous phase consisting of 80.0 g gelatin, 30.0 g of a 10% solution of Alkanol-XC, a mixture of isomers of di-isopropyl and tri-isopropyl naphthalene sodium sulfonate surfactant from Dupont, and 650.0 g distilled water and passing this mixture through a colloid mill 5 times followed by evaporation of the ethyl acetate using a rotary evaporator and replacement with distilled water to yield a dispersion having 6.0% scavenger and 8.0% gelatin, called Dispersion C. A second oxidized developer scavenger dispersion, called Dispersion D was prepared like Dispersion C except that 60.0 g di-n-butylphthalate was replaced with 15.0 g of diethyllauramide and 650.0 g distilled water was replaced with 695.0 g distilled water. Another oxidized developer scavenger dispersion was prepared by dissolving 60.0 g of ODS-2 in 120.0 g of 2,2-butoxyethoxyethylacetate at 100° C., then combining this solution with an aqueous phase consisting of 80.0 g gelatin, 60.0 g of 10% Alkanol-XC and 680.0 g distilled water. This mixture was passed through a colloid mill 5 times, then chill set, noodled and washed for 6 hours to remove the solvent to yield a dispersion having 6.0% scavenger and 8.0% gelatin, called Dispersion E.

A series of coating compositions were then prepared consisting of 1.5% yellow filter dye (YFD), 1.5% oxidized developer scavenger (ODS), 8.5% gelatin, 3.2% of a 5% solution of Triton-X200 (Union Carbide), 1.1% of a 10% solution of Surfactant 10G, a polyglycidol surfactant from Dixie, and 1.1% of a solution containing 12.83 g/L tetrachlorodiammoniumpalladate and 12.83 g/L 1,2-ethanediaminedihydrochloride. The coating compositions were adjusted to pH 5.3 using 1.0% sodium hydroxide. The various combinations of dyes and scavengers employed are given in Table I.

TABLE I

| Coating Solution | Dye Dispersion | Scavenger Dispersion |
|---|---|---|
| 1 (Comparison) | A (YFD - 31) | D (ODS - 24) |
| 2 (Comparison) | B (YFD - 4) | C (ODS - 24) |
| 3 (Invention) | B (YFD - 4) | E (ODS - 2) |

Figure 2:
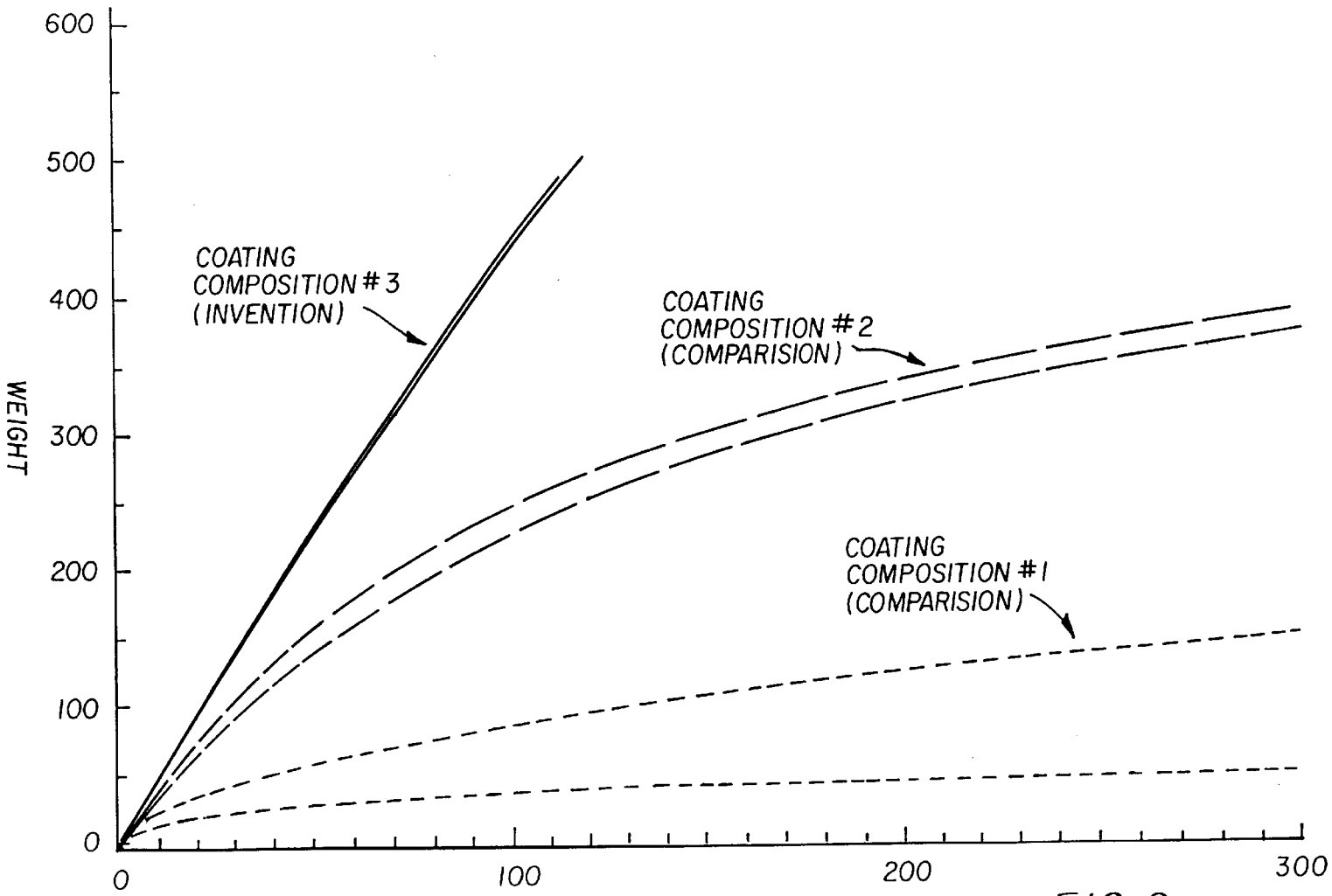

500 g of each coating composition was passed through a Grade 24 glass-fiber depth filter (Hollingworth and Vose) under pressure (5 psi) before and after holding at 45° C. for 21 hours. The time required for the coating composition to pass through the filter is an indication of the stability of the solution. More stable solutions filter through more rapidly than less stable solutions. Filterability of the coating compositions were evaluated by measuring the weight of solution passing through the filter as a function of time. The results for two repeated trials are illustrated in FIG. 1 for the fresh solutions and in FIG. 2 for the solutions held for 21 hours at 45° C. The results indicate that the fresh comparative solutions are less filterable than the fresh composition of the present invention. The results also show that the comparative solutions exhibited reduced filterability following extended melt hold, while the inventive solution shows no change in filterability after melt hold.

ODS 24:

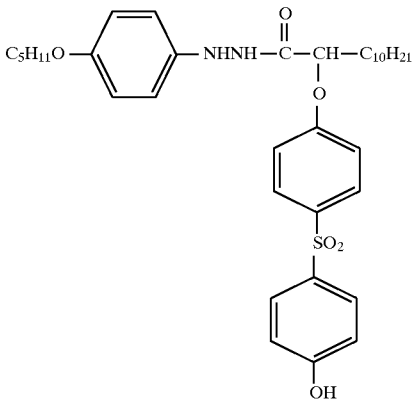

EXAMPLE 2

A solid particle dispersion of YFD-31 was prepared by placing 125.0 g of dye in a 2500 ml glass jar containing 186.6 g of a 6.7% Triton X-200 solution, 188.4 g distilled water and 1250 ml of 1.8 mm ZIR beads. The jar was rolled at a speed of 94 ft/min for 15 days. After milling, the slurry was diluted to 10% dye with distilled water. The final dispersion, called Dispersion F, contained well dispersed particles less than 1 micron in size. Similar dispersions were also prepared using YFD-4 and YFD-1 called Dispersions G and H, respectively.

Oxidized developer scavenger dispersions of ODS-24 and ODS-2 were prepared like Dispersion C in Example 1 and called Dispersions I and J, respectively.

A series of coating compositions were prepared using these dye and scavenger dispersions using the same components and levels described in Example 1. These solutions were subjected to the filterability test employed in Example 1 before and after a 21 hour melt hold at 45° C. The amount of coating composition passed through the filter (in grams) after 200 sec before and after melt hold is given in Table II.

TABLE II

| Coating Solution | Dye Dispersion | Scavenger Dispersion | Fresh | 21 h/45° C. | % Decrease |
|---|---|---|---|---|---|
| 4 (Comparison) | F (YFD - 31) | I (ODS - 24) | 207.5 g | 37.6 g | 82% |
| 5 (Invention) | F (YFD - 31) | J (ODS - 2) | 196.4 g | 141.6 g | 28% |
| 6 (Comparison) | G (YFD - 4) | I (ODS - 24) | 167.4 g | 63.9 g | 62% |
| 7 (Invention) | G (YFD - 4) | J (ODS - 2) | 149.0 g | 89.1 g | 40% |
| 8 (Comparison) | H (YFD - 1) | I (ODS - 24) | 329.0 g | 259.8 g | 21% |
| 9 (Invention) | H (YFD - 1) | J (ODS - 2) | 342.3 g | 1890.5 g | 15% |

These results also indicate that improved filterability is obtained with the combination of dyes and scavengers of the present invention.

The invention has been described in detail with particular reference to preferred embodiments, but it will be understood that variations and modifications can be effected within the spirit and scope of the invention.

What is claimed is:

1. A photographic element comprising a support having thereon at least one silver halide emulsion layer and a layer which is the same or different from said silver halide layer, comprising a binder having dispersed therein:

a) particles comprising a filter dye of Formula I:

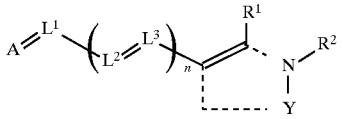

(I)

wherein

A=an acidic nucleus selected from the group consisting of benzoylacetonitrile, 2-phenyl-1,1,3-tricyanopropene, 5-pyrazolone, isooxazolone, barbituric acid, thiobarbituric acid, rhodanine, hydantoin, thiohydantoin, oxazolidindione, pyrazolidindione, indandione, pyrazolopyridone, 1,2,3,4-tetrahydroquinolin-2,4-dione, 3-oxo-2,3-dihydrobenzo[d]thiophene-1,1-dioxide and 3-dicynaomethine-2,3-dihydroxybenzo[d]thiophene-1,1-dioxide;

$L^{1-3}$=each independently represents a substituted or unsubstituted methine group;

n=0 or 1;

$R^{1-2}$=each independently represents hydrogen or an alkyl, aryl or acyl groups (including alkoxycarbonyl, amido and carboxyl);

Y=non-metal atoms which form a five membered heterocyclic ring optionally comprising a fused substituted or unsubstituted benzene ring; and wherein the dye comprises at least one ionizable group with a pKa value between 4–11 such as a carboxyl group, a sulfonamido group or a sulfamoyl group;

or a filter dye of Formula II:

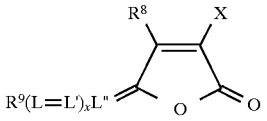

(II)

$R^8$ is substituted or unsubstituted alkyl or aryl;

$R^9$ is substituted or unsubstituted alkyl or aryl or a substituted or unsubstituted aromatic heterocyclic nucleus; and X is an electron withdrawing group;

L, L', and L" are each independently a substituted or unsubstituted methine group; and x is 0 or a positive interger of from 1 to 6;

and b) a hydrazide oxidized developer scavenger of Formula III:

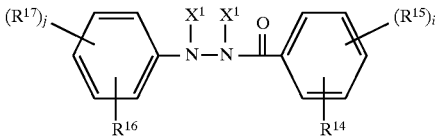

(III)

wherein $X^1$=hydrogen or a process cleavable group;

$R^{14}$=an electron withdrawing and aqueous solubilizing group;

$R^{15}$=a substituent group;

$R^{16}$=a ballasting group;

$R^{17}$=a substituent group;

i=1, 2, 3, or 4; and j=1, 2, 3, or 4.

2. A photographic element according to claim 1, wherein the filter dye is of formula I.

3. A photographic element according to claim 2, wherein the filter dye is of formula Ia:

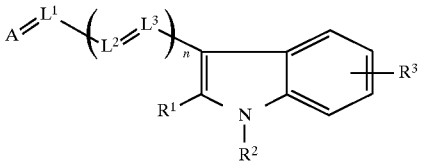

(Ia)

wherein

A=an acidic nucleus selected from the group consisting of benzoylacetonitrile, 2-phenyl-1,1,3-tricyanopropene, 5-pyrazolone, isooxazolone, barbituric acid, thiobarbituric acid, rhodanine, hydantoin, thiohydantoin, oxazolidindione, pyrazolidindione, indandione, pyrazolopyridone, 1,2,3,4-tetrahydroquinolin-2,4-dione, 3-oxo-2,3-dihydrobenzo[d]thiophene-1,1-dioxide and 3-dicynaomethine-2,3-dihydroxybenzo[d]thiophene-1,1-dioxide;

$L^{1-3}$=each independently represents a substituted or unsubstituted methine group;

n=0 or 1;

$R^{1-2}$=each independently represents hydrogen or an alkyl, aryl or acyl groups (including alkoxycarbonyl, amido and carboxyl); and $R^3$=hydrogen or a substituent group and wherein the dye comprises at least one ionizable group with a pKa value between 4–11 such as a carboxyl group, a sulfonamido group or a sulfamoyl group.

4. A photographic element according to claim 2, wherein the filter dye is of formula Ib:

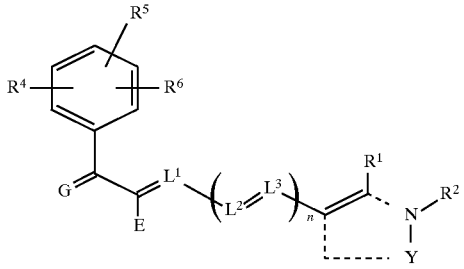

(Ib)

wherein $R^{4-6}$=each independently represents hydrogen or a substituent group;

G=O or dicyanovinyl (—C(CN)$_2$);

E=an electron withdrawing group;

$L^{1-3}$=each independently represents a substituted or unsubstituted methine group;

n=0 or 1;

$R^{1-2}$=each independently represents hydrogen or an alkyl, aryl or acyl groups (including alkoxycarbonyl, amido and carboxyl);

Y=non-metal atoms which form a five membered heterocyclic ring optionally comprising a fused substituted or unsubstituted benzene ring; and wherein the dye comprises at least one ionizable group with a pKa value between 4–11 such as a carboxyl group, a sulfonamido group or a sulfamoyl group.

5. A photographic element according to claim 2, wherein the filter dye is of formula Ic:

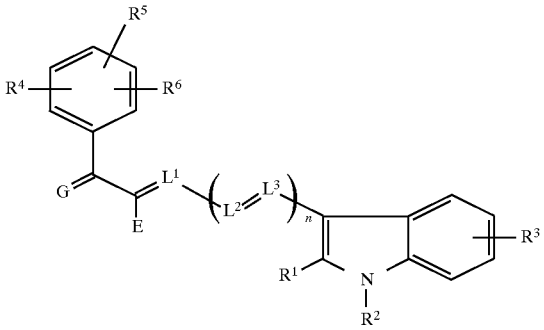

(Ic)

wherein $R^{4-6}$=each independently represents a hydrogen or a substituent group;

G=O or dicyanovinyl (—C(CN)$_2$);

E=an electron withdrawing group;

$L^{1-3}$=each independently represents a substituted or unsubstituted methine group;

n=0 or 1;

$R^{1-2}$=each independently represents hydrogen or an alkyl, aryl or acyl groups (including alkoxycarbonyl, amido and carboxyl);

$R^3$=hydrogen or a substituent group and wherein the dye comprises at least one ionizable group with a pKa value between 4–11 such as a carboxyl group, a sulfonamido group or a sulfamoyl group.

6. A photographic element according to claim 1, wherein the filter dye is of formula II.

7. A photographic element according to claim 1, wherein the hydrazide oxidized developer scavenger is of formula IIIa:

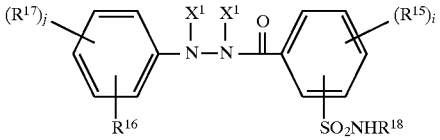

(IIIa)

wherein $R^{18}$=hydrogen, acyl, alkyl or aromatic substituent;

$X^1$, $R^{15}$, $R^{16}$, $R^{17}$, i and j are defined as in claim 1.

8. A photographic element according to claim 1, wherein the hydrazide oxidized developer scavenger is of formula IIIb:

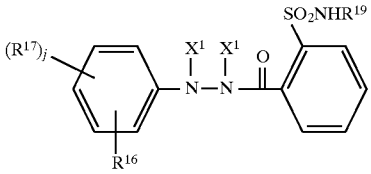

(IIIb)

wherein $R^{19}$=hydrogen or acyl substituent;

$X^1$, $R^{16}$, $R^{17}$, and j are defined as in claim 1.

9. A photographic element according to claim 1, wherein the hydrazide oxidized developer scavenger is of formula IIIc:

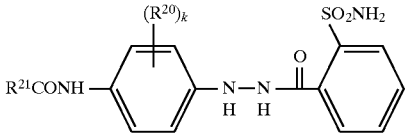

(IIIc)

wherein $R^{20}$=a substituent group;

$R^{21}$=a ballasting group; and k=1, 2, 3 or 4.

10. A photographic coating composition comprising an aqueous medium containing a hydrophilic colloid and having dispersed therein:

a) particles comprising a filter dye of Formula I:

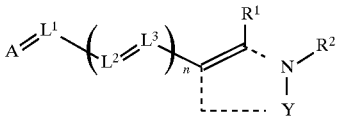

(I)

wherein

A=an acidic nucleus selected from the group consisting of benzoylacetonitrile, 2-phenyl-1,1,3-tricyanopropene, 5-pyrazolone, isooxazolone, barbituric acid, thiobarbituric acid, rhodanine, hydantoin, thiohydantoin, oxazolidindione, pyrazolidindione, indandione, pyrazolopyridone, 1,2,3,4-tetrahydroquinolin-2,4-dione, 3-oxo-2,3-dihydrobenzo[d]thiophene-1,1-dioxide and 3-dicynaomethine-2,3-dihydroxybenzo[d]thiophene-1,1-dioxide;

$L^{1-3}$=each independently represents a substituted or unsubstituted methine group;

n=0 or 1;

$R^{1-2}$=each independently represents hydrogen or an alkyl, aryl or acyl groups (including alkoxycarbonyl, amido and carboxyl);

Y=non-metal atoms which form a five membered heterocyclic ring optionally comprising a fused substituted or unsubstituted benzene ring; and wherein the dye comprises at least one ionizable group with a pKa value between 4–11 such as a carboxyl group, a sulfonamido group or a sulfamoyl group;

or a filter dye of Formula II:

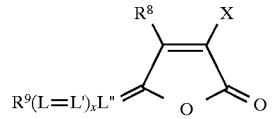

(II)

$R^8$ is substituted or unsubstituted alkyl or aryl;

$R^9$ is substituted or unsubstituted alkyl or aryl or a substituted or unsubstituted aromatic heterocyclic nucleus; and X is an electron withdrawing group;

L, L', and L" are each independently a substituted or unsubstituted methine group; and x is 0 or a positive interger of from 1 to 6;

and b) a hydrazide oxidized developer scavenger of Formula III:

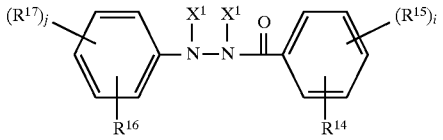

(III)

wherein $X^1$=hydrogen or a process cleavable group;

$R^{14}$=an electron withdrawing and aqueous solubilizing group;

$R^{15}$=a substituent group;

$R^{16}$=a ballasting group;

$R^{17}$=a substituent group;

i=1, 2, 3, or 4; and j=1, 2, 3, or 4.

11. A photographic coating composition according to claim 10, wherein the hydrophilic colloid is gelatin.

12. A photographic element according to claim 1, wherein $R^{15}$ is a substituent group other than an electron donating group.

13. A photographic coating composition according to claim 10, wherein $R^{15}$ is a substituent group other than an electron donating group.

* * * * *